United States Patent [19]

Shinohara

[11] Patent Number: 4,862,860

[45] Date of Patent: Sep. 5, 1989

[54] BLOW-BYE GAS RETURN DEVICE FOR INTERNAL COMBUSTION ENGINES

[75] Inventor: Hiroyuki Shinohara, Tokyo, Japan

[73] Assignee: Fuji Jukogyo Kabushiki Kaisha, Tokyo, Japan

[21] Appl. No.: 261,890

[22] Filed: Oct. 25, 1988

[30] Foreign Application Priority Data

Oct. 30, 1987 [JP] Japan ..... 62-275316

[51] Int. Cl.[4] ..... F02M 25/06

[52] U.S. Cl. ..... 123/572

[58] Field of Search ..... 123/572, 573, 574, 494

[56] References Cited

U.S. PATENT DOCUMENTS

| | | | |
|---|---|---|---|
| 3,116,727 | 1/1964 | Dietrich | 123/572 |
| 3,589,347 | 6/1971 | Sawada | 123/572 |
| 4,345,573 | 8/1982 | Obata | 123/572 |
| 4,719,891 | 1/1988 | Porth et al. | 123/494 |

FOREIGN PATENT DOCUMENTS 59-7211 1/1984 Japan .

*Primary Examiner*—Willis R. Wolfe
*Assistant Examiner*—M. Macy
*Attorney, Agent, or Firm*—Beveridge, DeGrandi & Weilacher

[57] ABSTRACT

In a blow-bye gas return device of an internal combustion engine having a blow-bye gas return passage for conducting blow-bye gas from the engine into an integrally combined structure of a fuel injection body and a throttle body, the blow-bye gas return passage has a blow-bye gas discharge orifice which opens toward the upstream side of an air intake passage formed within the injection body around a fuel injector. The discharge orifice is located upstream of the injection port of the injector and on the opposite side of an air flow sensor, whereby the blow-bye gas discharge orifice is free from the injection fuel from the injection port and the air flow sensor is free from oil mist discharged from the blow-bye gas discharge orifice. Further, the blow-bye gas discharge orifice is located at a position where the dynamic pressure is low, whereby the flow resistance is low.

4 Claims, 2 Drawing Sheets

BLOW-BYE GAS RETURN DEVICE FOR INTERNAL COMBUSTION ENGINES

BACKGROUND OF THE INVENTION

The present invention relates to a blow-bye gas return device for internal combustion engines, whereby the blow-bye gas can be returned to the upstream side of a throttle valve.

As is disclosed, for example, in Japanese Utility Model Laid-Open Publication (Kokai) No. 59-7211 published Jan. 18, 1984, well known to those skilled in the art is a blow-bye gas return system of the type in which the blow-bye gas within the cylinder block is returned through a blow-bye gas passage and a PCV valve to the downstream side of the throttle valve while a discharge orifice of another blow-bye gas passage is opened at the upstream side of the throttle valve so that when the internal combustion engine is required to operate at high speed under high load, the blow-bye gas is induced through the discharge orifice.

Meanwhile, in order to simplify the construction of the fuel supply system for internal combustion engines, there has been devised and proposed a system in which a fuel injector body and a throttle body are provided as a unitary construction in such a way that a fuel injector is disposed at a position immediately upstream in relation to the throttle valve and in which a hot-wire type air flow sensor is disposed at one side of the air passage through the injection body.

However, there arises the problem that because the air flow sensor is of the hot-wire type, measures must be taken for reducing the polution of the flow sensor film to a minimum so that the flow sensor output can be maintained at a high degree of accuracy. As is well known in the art, in the air flow sensor of the type described above, a hot-wire made of a platinum wire is disposed in the air flow passage and the quantity of heat derived by the air flowing past the hot wire is electrically sensed to measure the quantity of intake air. Therefore, when dust particles, oil mist, gasoline vapor and the like, adhere to the surface of the hot wire, measurement errors occur and consequently the fuel injection timing control as well as the ignition timing control cannot be carried out correctly. In particular, oil mist operates as an adhesive agent, causing the dust particles to adhere to the hot wire so that the flow of oil mist to the upstream side of the air flow sensor must be avoided. It therefore follows that on the upstream side of the throttle valve, the discharge orifice through which the blow-bye gas is returned, should not be opened at a position upstream of the air flow sensor.

However, in the case of the unitary construction of the throttle body and the injection body, the distance between the throttle valve and the fuel injector is extremely short so that when the discharge orifice is opened at a position downstream of the fuel injector, there arises the problem that gasoline or fuel is sucked to the blow-bye gas passage through the discharge orifice, causing so-called oil dilution.

SUMMARY OF THE INVENTION

In view of the above, the primary object of the present invention is to provide a blow-bye gas return device for internal combustion engines in which the flow of mist to the blow-bye gas discharge orifice can be prevented and in which, even when the injection body and the throttle body are constructed into a unitary construction with the air flow sensor incorporated therein, it is possible to select in the injection body a position where the return of blow-bye gas at the upstream side of the throttle valve can be accomplished without causing any adverse effects, such as sucking of the fuel ejected from the fuel injector.

To the above and other ends, in a device of the type in which the fuel injection body and the throttle body are formed into a unitary construction in such a way that the injector is disposed at a position upstream of the throttle valve and the hot-wire type air flow sensor is disposed at one side of the air flow passage in the injection body, according to the present invention, a blow-bye gas return passage is provided with its discharge orifice opened toward the upstream side of the air intake passage at a position where the dynamic pressure is low and which is on the upstream side of the injection orifice of the injector.

In the blow-bye gas return device of the above described character, the air flow sensor is prevented from being directly exposed to oil mist so that the pollution thereof can be avoided; the return of blow-bye gas can be realized; and oil dilution due to the flow of fuel into the blow-bye gas discharge orifice can be prevented. In addition, since the position in the air intake passage at which the dynamic pressure is low is selected, the resistance of the blow-bye gas return passage against the intake air can be reduced to a minimum and a sufficient size of the blow-bye gas return passage for securing the return of a desired quantity of blow-bye gas can be attained.

DETAILED DESCRIPTION OF THE PREFERRED EMBODIMENT

Figure 1:
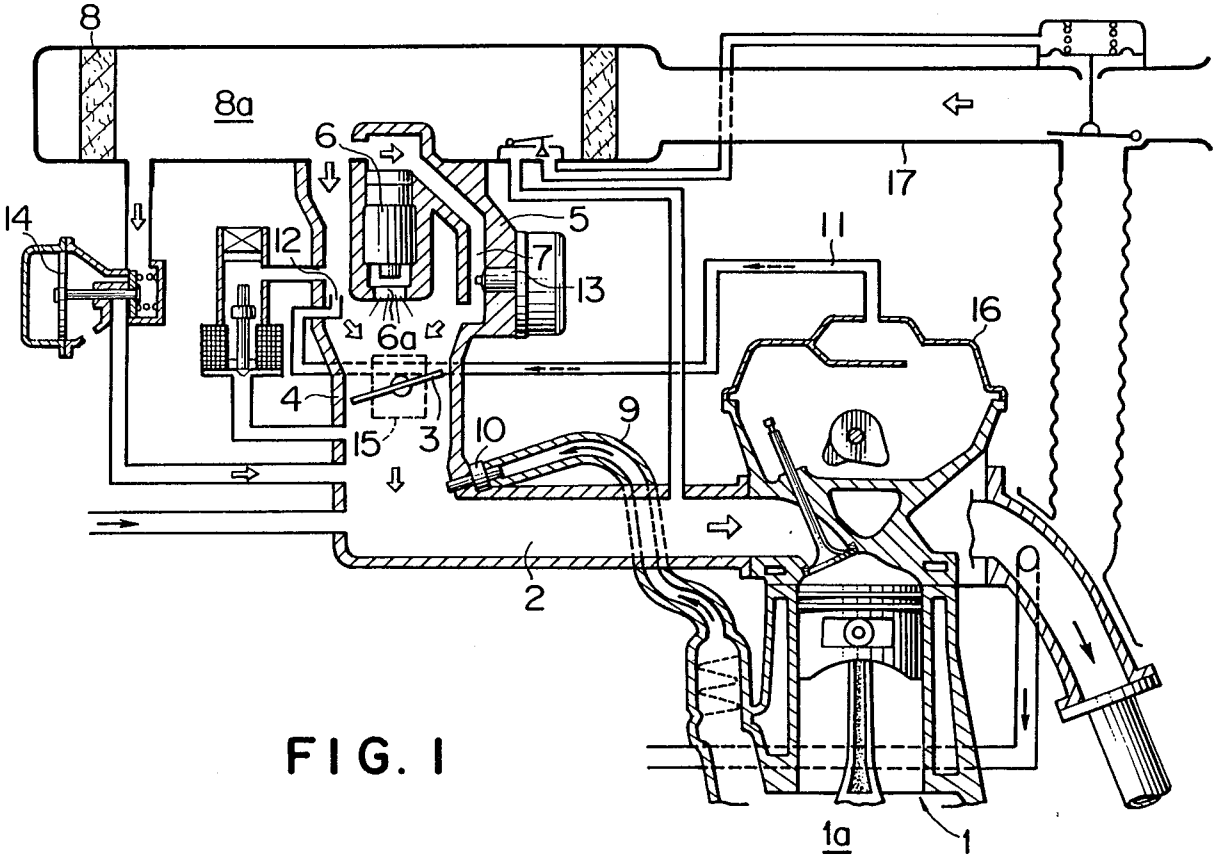
FIG. 1 is a schematic view of a preferred embodiment of the present invention.
Figure 2:
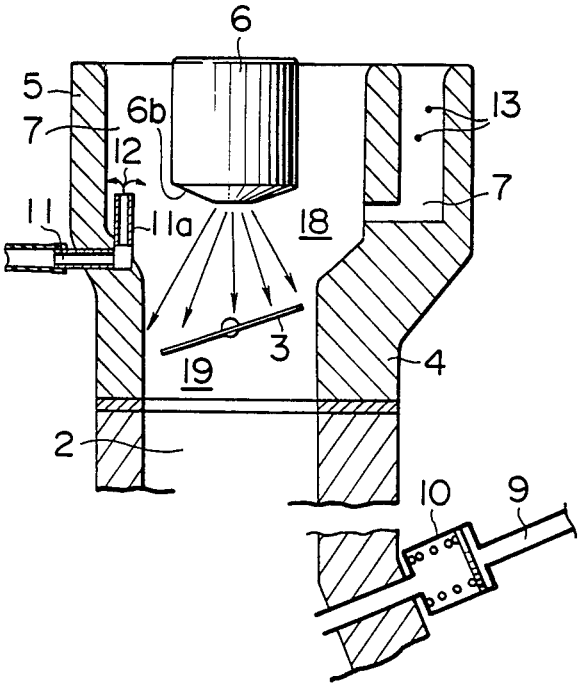
FIG. 2 is a sectional view on an enlarged scale of a major portion thereof.

Referring now to FIGS. 1 and 2, a preferred embodiment of the present invention will be described in detail hereinafter.

In FIG. 1, reference numeral 1 represents an engine whose intake pipe 2 is communicated with a throttle body 4 in which is disposed a throttle valve 3. The throttle body 4 and an injection body 5 are integrally formed into a unitary body. A fuel or gasoline injector 6 is formed at the center of the interior of the injection body 5 and has an injection port **6*a* which opens toward the throttle valve 3. An annular air intake passage 7 defined around the injector 6 is communicated with the interior space 8*a* of an annular air cleaner 8 disposed immediately upstream of the injection body 5. To the air cleaner 8 is connected an air conduit 17. One end of a first blow-bye gas return passage 9 in communication with the crank case 1*a* of the engine 1 is communicated with the intake pipe 2 through a PCV (positive crankcase ventilation) valve 10 at the downstream side of the throttle valve 3. A second blow-bye gas return passage 11 is communicatively connected to the interior of a valve locker cover 16 at the top portion thereof and has a discharge orifice 12 which opens into the injection body 5. A hot-wire type air flow meter or sensor 13 is mounted on one side of the air intake passage 7, and one end portion of the second blow-bye gas return passage 11 is extended in the form of a relatively short pipe as shown at 11***a* in FIG. 2 into the air intake passage 7 at the other side thereof in such a way that the discharge orifice 12 is directed toward the upstream side. The extended pipe portion 11*a* is in opposing relationship with a shoulder portion 6*b* of the injector 6 and is outside of the region of flow of the fuel injected from the injection port 6*a*. The interior flow passage formed in the unitary body of the throttle body 4 and the injection body 5 includes an upstream passage portion 18 of a greater cross-sectional area and a downstream passage portion 19 of a smaller cross-sectional area. The extended pipe portion 11*a* is disposed on the side wall of the upstream passage portion 18 of greater cross-sectional area. This means that the pipe portion 11*a* is at a position at which the dynamic pressure of the intake air flow is low.

In FIG. 1, reference numeral 14 denotes an idle speed control valve; and 15, a throttle sensor.

In the operation of the above described device, the blow-bye gas flows from within the engine 1 into the intake pipe 2 through the two return passages 9 and 11 as is well known in the art.

According to the above-described device, the discharge orifice 12 of the second blow-bye gas return passage 11 is opened at the side of the air intake passage 7, which is opposite to or remote from the side of the air intake passage at which the hot-wire type air flow sensor 13 is mounted, and furthermore the orifice 12 is directed toward the upstream side. As a result, there is no likelihood that oil mist, which comes from the engine through the orifice 12, flows toward the air flow sensor 13. Moreover, the discharge orifice 12 is spaced apart from the fuel injection port 6*a* of the injector 6 so that there is no likelihood that the fuel flows into the second blow-bye gas return passage 11 through its discharge orifice 12, resulting in the so-called oil dilution. Furthermore, the extended or projected portion 11*a* is arranged at a position of the air intake passage 7 at which the dynamic pressure of the intake air flowing therethrough is low so that the intake air flow encounters less resistance and therefore the air flow sensor is not subjected to adhesion of oil mist. In addition, the diameter of the second blow-bye gas return passage 11 can be selected in such a manner that the return of a desired quantity of blow-bye gas can be ensured. As in the case of conventional blow-bye gas return devices, the first blow-bye gas return passage 9 operates to return blow-bye gas into the intake system under the control of the PCV valve 10 and due to the negative pressure in the intake pipe 2.

As described above, according to the present invention, in the blow-bye gas return device in which the throttle body is formed integrally with the injection body and the hot-wire type air flow sensor is installed in the air intake passage formed through the injection body, even when blow-bye gas is returned into the air intake passage, no oil mist flows toward the air flow sensor. In addition, the suction of fuel into the second blow-bye gas return passage can by prevented so that oil dilution can be avoided. Moreover, one end portion of the second blow-bye gas return passage is extended into the air intake passage at a portion at which the dynamic pressure is low therefore the resistance encountered by the intake air flowing through the air intake passage due to the existence of the extended portion can be reduced to a minimum. Furthermore, the diameter of the second blow-bye gas return passage can be selected so as to permit the return of a desired quantity of blow-bye gas.

What is claimed is:

1. A blow-bye gas return device for an internal combustion engine, comprising:

an intake pipe connected to an engine;

an injection body having therein a fuel injector with an injection port and disposed relative to said intake pipe to inject fuel from said injector into the intake pipe, the fuel injector being so disposed relative to the injection body that an air intake passage is defined in the injection body around the fuel injector;

a throttle body having a throttle valve therein and disposed relative to the injection body and the intake pipe such that the throttle valve throttles the flow of the fuel injected by said fuel injector before the flow enters the intake pipe, said throttle body and said injection body being formed integrally into a unitary body to define therein a flow passage communicating with said air intake passage at the upstream side and with said intake pipe at the downstream side;

a hot-wire type air flow sensor mounted on one side of the air intake passage; and blow-bye gas return passage means connecting the engine to said unitary body to conduct blow-bye gas from the engine into said unitary body at a position upstream of the throttle valve, said blow-bye gas return passage means having a blow-bye gas discharge orifice which opens toward the upstream side of the air intake passage and at the upstream side of said injection port of the injector, said discharge orifice being located at a position where the dynamic pressure is low.

2. The blow-bye gas return device according to claim 1 wherein said blow-bye gas discharge orifice is formed at the tip end of a relatively short pipe portion, extending toward the upstream side of the air intake passage.

3. The blow-bye gas return device according to claim 2, wherein said flow passage of the unitary body includes an upstream passage portion of a greater cross-sectional area and a downstream passage portion of a smaller cross-sectional area, and said pipe portion is disposed in said upstream passage portion.

4. The blow-bye gas return device according to claim 1, wherein said blow-bye gas discharge orifice is located at the side of the air intake passage, opposite to the side at which the air flow sensor is mounted.

* * * * *